US007836887B1

(12) United States Patent
Kling

(10) Patent No.: US 7,836,887 B1
(45) Date of Patent: Nov. 23, 2010

(54) PROTECTIVE MASK

(76) Inventor: Robert J. Kling, 3416 Woodford Rd., Cincinnati, OH (US) 45213

( * ) Notice: Subject to any disclaimer, the term of this patent is extended or adjusted under 35 U.S.C. 154(b) by 974 days.

(21) Appl. No.: 11/633,794

(22) Filed: Dec. 5, 2006

Related U.S. Application Data

(60) Provisional application No. 60/741,804, filed on Dec. 5, 2005.

(51) Int. Cl.
*A62B 7/10* (2006.01)
*A62B 18/02* (2006.01)

(52) U.S. Cl. ..... 128/206.16; 128/205.27; 128/205.29; 128/206.12; 128/206.21

(58) Field of Classification Search ..... 128/205.27–205.29, 206.12–206.14, 206.16, 128/206.17, 206.19, 206.21, 206.27, 206.28, 128/207.11, 207.17
See application file for complete search history.

(56) References Cited

U.S. PATENT DOCUMENTS

| | | | | | |
|---|---|---|---|---|---|
| 3,713,448 | A * | 1/1973 | Arrott | 128/207.17 |
| 4,038,979 | A | 8/1977 | McCosker | |
| 4,248,220 | A * | 2/1981 | White | 128/206.19 |
| 4,986,649 | A * | 1/1991 | Smith | 351/130 |
| 5,233,978 | A * | 8/1993 | Callaway | 128/205.25 |
| 5,265,280 | A * | 11/1993 | Walsh | 2/206 |
| 5,655,263 | A * | 8/1997 | Stoller | 24/3.3 |
| 5,717,991 | A * | 2/1998 | Nozaki et al. | 2/9 |
| 5,940,938 | A * | 8/1999 | Davancens et al. | 24/3.3 |
| 5,954,055 | A * | 9/1999 | Miyake | 128/857 |
| 6,092,897 | A * | 7/2000 | Smerdon, Jr. | 351/157 |
| 6,116,236 | A * | 9/2000 | Wyss | 128/200.24 |
| 6,631,718 | B1 | 10/2003 | Lovell | |
| 7,004,165 | B1 * | 2/2006 | Salcido | 128/205.27 |
| 7,077,137 | B2 * | 7/2006 | Russell | 128/206.12 |
| 2002/0056450 | A1 * | 5/2002 | Lee | 128/201.15 |
| 2002/0133914 | A1 * | 9/2002 | Scott et al. | 24/3.3 |
| 2003/0131852 | A1 * | 7/2003 | Shafer et al. | 128/206.21 |
| 2003/0150459 | A1 * | 8/2003 | Campbell | 128/206.13 |
| 2004/0078860 | A1 * | 4/2004 | Bell et al. | 2/9 |
| 2005/0081856 | A1 * | 4/2005 | Cheng | 128/205.25 |
| 2006/0130841 | A1 * | 6/2006 | Spence et al. | 128/206.19 |
| 2006/0180151 | A1 * | 8/2006 | Rinaldi | 128/206.11 |
| 2006/0272636 | A1 * | 12/2006 | Orem et al. | 128/201.11 |
| 2008/0092909 | A1 * | 4/2008 | Hahne | 128/863 |

* cited by examiner

*Primary Examiner*—Patricia M Bianco
*Assistant Examiner*—Rachel T Young
(74) *Attorney, Agent, or Firm*—Charles R. Wilson

(57) ABSTRACT

A personalized protective mask comprises a malleable wire frame, a filtration bag, and a tether. The filtration bag is positioned over the wire frame and the tether is attached at each end to an ear section of the wire frame. The mask is placed over the face of the individual who then bends the wire frame to force it to conform to the individual's own face contour. The tether pulls tight the filtration bag to the individual's face for creating a mask which fully covers the user's nose and mouth. The protective mask is comfortable to wear, whether in-use on the face or in a stand-by position around the user's neck.

17 Claims, 2 Drawing Sheets

PROTECTIVE MASK

This application claims the benefit of U.S. Provisional Application No. 60/741,804, filed Dec. 5, 2005.

FIELD OF THE INVENTION

This invention relates to a protective mask useful in preventing inhalation of airborne materials. More particularly, the invention relates to a personalized protective mask which allows the user to conveniently wear it around the neck, yet readily position it on the face whereby it conforms to the contour of the particular user's face.

BACKGROUND OF THE INVENTION

Face masks are well known and have been used extensively in the medical field where airborne infectious materials can be encountered. The masks are also widely used in industries such as construction, road building, and manufacturing where inhalation of dust particles are to be prevented. Commercial painters as well routinely use protective masks to reduce breathing of harmful volatiles. Importantly, emergency and disaster relief workers who must wear masks require long-term comfortable protection from airborne particulates.

The commonly worn masks in the medical field are pleated rectangles of fibrous filtration material shaped to cover the nose/mouth area and held to the ears with loops of elastic. The commonly worn mask in the construction and painting trades is a shaped covering made of fibrous filtration material having a semi-rigid perimeter which approximates a typical facial contour. The existing masks are somewhat effective for their stated purpose. However, they are cumbersome and uncomfortable during use, allow a substantial amount of unfiltered air leakage, exert a painful force on the tip of the nose, interfere with safety glasses, and require a special effort to retrieve and put in position. When the mask wearing interval ends, the mask is either uncomfortably worn around the neck or discarded—a significant drawback when long-term use is crucial.

The need for a comfortable and effective protective mask remains. In recent years, the need has expanded to include the general population. Travelers on buses, subways, and especially airplanes are forced to breath air that may carry contaminates harmful to one's health. Even office workers, tourists, and other individuals located in terrorist-prone areas have a need for a protective mask that can be worn which will filter out deadly airborne materials. Further, winter sports enthusiasts such as skiers and snowmobilers would benefit from the air warming capability of an air mask that can be comfortably worn.

For any mask to be fully effective in filtering out harmful and maybe even deadly contaminates, it must not allow unfiltered air leakage to reach the nose and mouth. A better filtering medium is not the answer. Many masks are designed to approximately fit a broad spectrum of face shapes. They are only partially effective. Some unfiltered air normally seeps in through gaps between the mask's perimeter and the face.

In accord with a need, a protective mask is designed to be continually and comfortably worn so as to be readily positioned when the need arises. A frame for the protective mask is adjustable at major bending points to ensure the mask conforms to the face. This results in a broader filtering area and less unfiltered air leakage.

SUMMARY OF THE INVENTION

A personalized protective mask is comfortable to wear both in an in-use mode on the face and in a stand-by mode around the neck. The mask is adjustably shaped to follow the contour of its user to cover the user's nose and mouth while allowing substantially no unfiltered airborne contaminates to seep into the mask's interior. The mask comprises a malleable wire frame which fits over the nose's bridge, follows the cheeks and fits over the ears. It is manually shaped by bending the wire frame to follow the face's contour. A filtration bag which is positioned on the wire frame is sized to cover the user's nose and mouth. A tether is attached to the wire frame to draw the protective mask to the face and hold the mask around the neck when not used. Once the malleable wire frame is properly shaped to the user's face contour, it retains that shape so as to personalize it to that particular individual. In case of need, the protective mask is readily positioned over the face and the tether tightened to create a mask which is very effective.

DETAILED DESCRIPTION OF THE INVENTION

The protective mask of the invention is described in detail and with particular reference to the drawings. The mask is intended to be personalized by the individual user when initially worn. Some wire frame bending is needed to conform it to the individual's face contour when first used. Minor adjustments can be made later depending on facial changes caused by any number of events.

Figure 1:
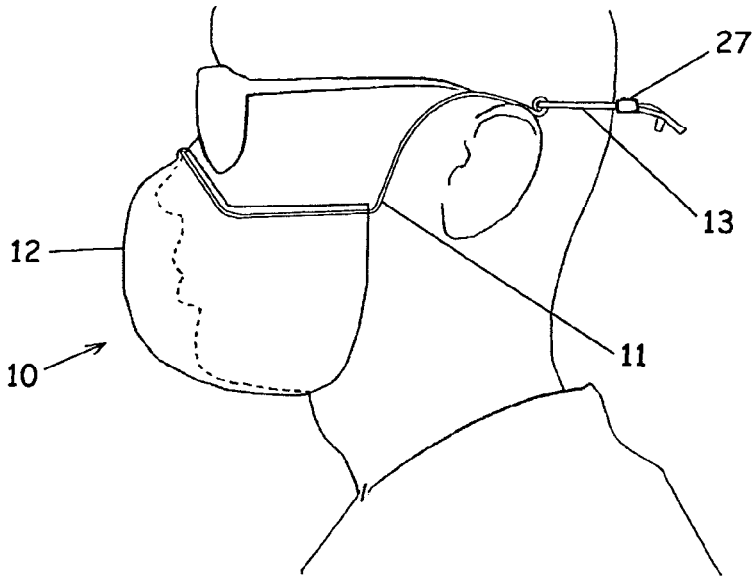
FIG. 1 is an environmental view showing the protective mask of the invention properly positioned on its user in an in-use mode.
Figure 2:
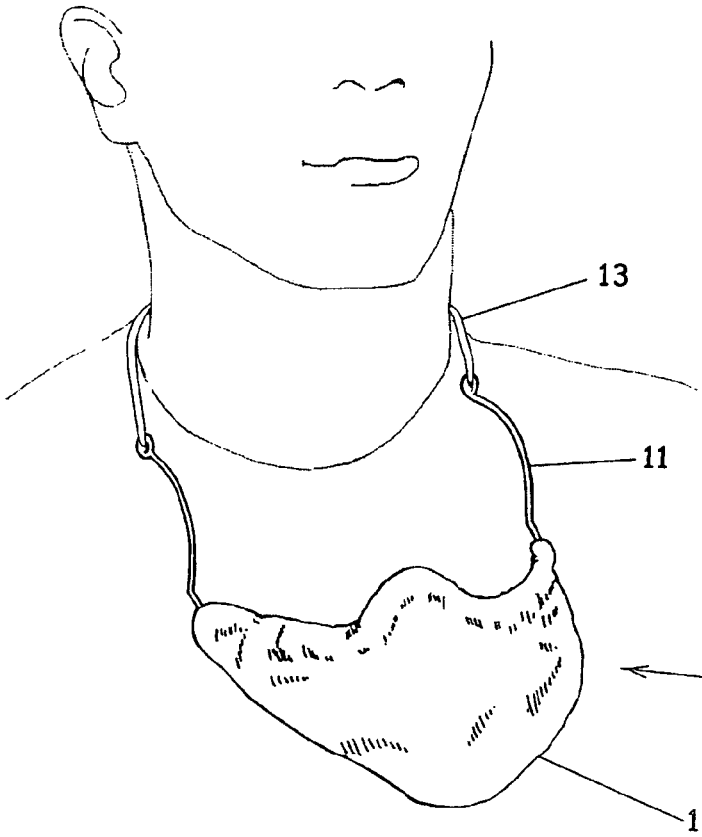
FIG. 2 is a second environmental view showing the protective mask of the invention on its user, but comfortably around the neck in a stand-by mode.

FIGS. 1 and 2 are environmental views showing the protective mask 10 of the invention in use. FIG. 1 shows the mask being worn in the in-use mode. A portion of the user's face is in dotted line form to show how a malleable wire frame 11 has been bent to closely follow the contour of the user's nose, cheeks and ears. A filtration bag 12 positioned on the wire frame 11 is sized to cover the user's nose and mouth. It should be understood the filtration bag need not cover the full nose, but most importantly covers enough of the nose to prevent filtered air reaching the nostrils. The filtration bag is further shaped to extend under the chin. A tether 13 extending from the wire frame is capable of being tightened to draw the wire frame along with the filtration bag to the user's face to substantially eliminate any air leakage gaps between the mask and the user.

FIG. 2 shows the protective mask 10 dangling around the user's neck in a stand-by mode. The tether has been loosened and the mask is simply allowed to drop down and rest on the user's chest. It should be readily apparent that the protective mask can be positioned in an in-use mode simply by pulling it up to the face and tightening its tether. No other adjustments need be made.

The mask 10 of the invention, still with reference to FIGS. 1 and 2, comprises the malleable wire frame 11, the filtration bag 12, and the tether 13. The three components interact to provide a protective mask which is made to conform to the user's face contour and which can be worn in an unobtrusive manner around the neck until needed.

Figure 3:
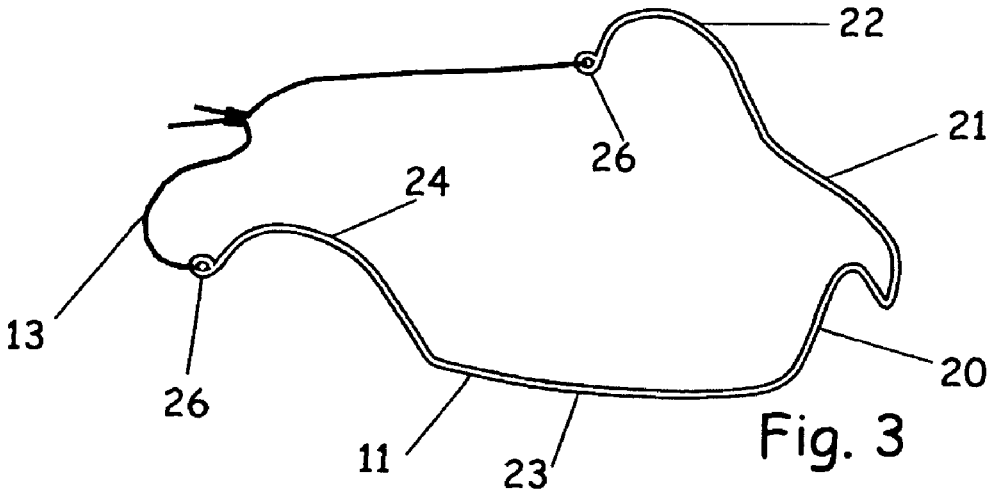
FIG. 3 is a view in perspective showing a malleable wire frame used in the protective mask of FIGS. 1 and 2.

Now with reference to FIG. 3, the malleable wire frame 11 is generally shaped to fit over the user's nose and ears like conventional eyeglasses. It is a wire which is thin enough and bendable enough to allow the needed shaping. It can be made of aluminum, stainless steel or any material which is bendable with ordinary force and retains its shape. The wire as shown has a constant diameter. In one embodiment of my invention described below, the wire has varying diameters with the thinner diameters in the general areas of where the wire is to be bent. Preferably, the wire is one continuous piece.

The wire frame 11 has five major bend sections; namely, a nose section 20, a left cheek section 21, a left ear section 22, a right cheek section 23, and a right ear section 24. The sections are connected together in an unbroken sequence. Each of the sections lends itself to facial contour adjustment so that the wire frame contacts the user's nose bridge, cheeks and ears. The contact is substantially continuous throughout the wire frame to ensure there is no substantial air leakage in the filtration bag 12 between the wire frame and the user's face.

The nose section 20 of the malleable wire frame 11 has an inverted U-shape designed to fit over the nose's bridge. Extending substantially horizontally from ends of the nose section 20 are the left cheek section 21 and the right cheek section 23. The cheek sections are slightly curved. Arch-shaped ear sections 22 and 24 extend from a distal terminus of the left and right cheek sections 21 and 23, respectively. All the sections are individually bent to closely follow the user's face contour. Thus, the nose section is first bent inwardly or outwardly to extend over and along the bridge of the user's nose. The cheek sections are bent at proximal, distal and central points to follow the user's cheek. The ear sections are bent to extend over the user's ears in a snug but comfortable manner. Initially, adjustments are made to the wire frame. However, once made, the frame retains its shape and becomes personalized to the user.

Still with reference to FIG. 3, the frame also has terminal loops 26 in the ear sections 22 and 24 to receive the tether 13. Further, foam or some similar cushioning material is optionally placed on the nose section for obvious comfort purposes.

Again with reference to FIG. 1, the wire frame's left side when viewed in elevation has a generally flared U-shape. The cheek section extends substantially horizontally. The nose section extends upwardly and outwardly from one end of the cheek section. The ear section extends upwardly and outwardly from the other end of the cheek section to an apex. The ear section further extends downwardly from its apex in a curved fashion terminating in a loop. The right side of the wire frame bar has an identical generally flared U-shape.

A secondary feature, important to those who wear safety glasses, is that the wire frame's shape as above described allows the mask to be worn without obstructing the use of eyewear of any nature. This further helps to ensure that the protective mask is worn for prolonged periods. The mask simply does not materially interfere with the individual's normal lifestyle.

The filtration bag 12 of the protective mask 10 fits over the frame 11. It is sized and shaped to extend down from the wire frame to cover the nose and mouth of the user. In particular, the user's nostrils and mouth are fully covered. As apparent in FIG. 1, the filtration bag extends under the chin. Its purpose is to filter out particulates and airborne materials of all nature to prevent their inhalation by the mask's user. Various air permeable fabrics, woven and non-woven, having the desired filtration properties are used. Non-permeable material can be used in conjunction with a canister with a filtering material such as activated charcoal. Such a canister would provide refined filtration and be replaceable. Further, the filtration bag 12 has elastic edging (not evident in the drawings) to hold it securely under the chin and along the jaw. Alternately, a drawstring extending around the filtration bag's periphery with spring-loaded tensioner provides this closing feature, important to reducing the amount of unfiltered air entering the user's respiratory system. The filtration bag 12 is substantially larger than existing particle masks to prevent uncomfortable deformation of the nose and to allow more filtration area.

The third component of the protective mask, the tether 13, is an elongated cord with means on each terminus to attach to the frame 11, over the loops 26. It has a length to extend around the backside of the user's head. A spring-loaded tensioner 27 interposed in the cord adds an adjustability feature. When tightened, it draws the wire frame back towards the user's ears, thereby tending to create a more snug fit against the face. A lesser function is to allow the mask's user to remove the face portion of the mask from the face and drop it and its associated wire frame down to a rest position on the user's chest. It, thus, can be comfortably worn around the neck, and placed in position on the face as the need arises. This convenience of use greatly enhances the chances of the protective mask continually being worn and thus always available when a threatening environment is about to be encountered. Additionally, the tether in tandem with the tensioner under the chin distributes the pressures on the nose and ears making it more comfortable to wear for long periods at a time.

The aforedescribed elongated cord can as well be an elastic band which is positioned on the ear loops of the wire frame. It must have a length to stretch around the backside of the user's head with minimal stretching for comfort reasons. The elastic band fulfills the function of the elongated cord and tensioner in creating a tighter fit mask. However, it is less desired because of limitations in serving as a means by which the protective mask can be hung around the neck in a stand-by mode.

Figure 4:
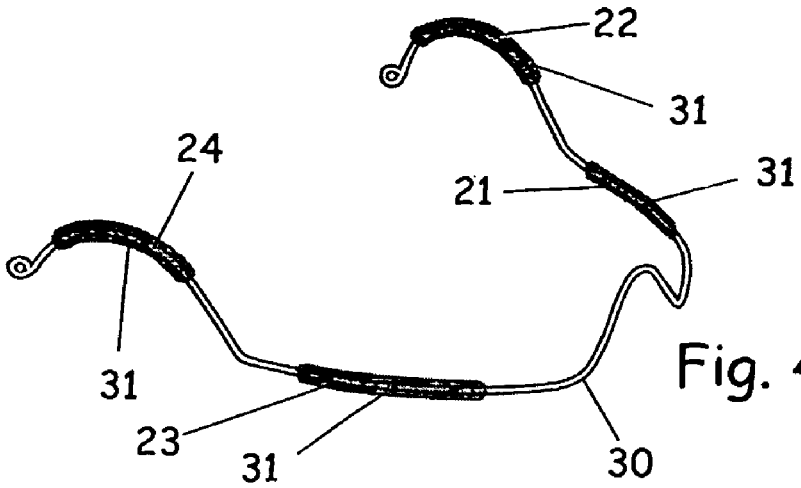
FIG. 4 is a view in perspective showing an embodiment of the invention with a malleable wire frame having spaced plastic claddings for shaping and maintaining ear and cheek configurations.

In a preferred embodiment shown in FIG. 4, a wire frame 30 has a plastic cladding 31 overlying at least a portion of the ear sections 22 and 24 and the cheek sections 21 and 23. The plastic cladding rigidifies these areas to serve as datum in conforming the malleable frame 11 to the face.

Figure 5:
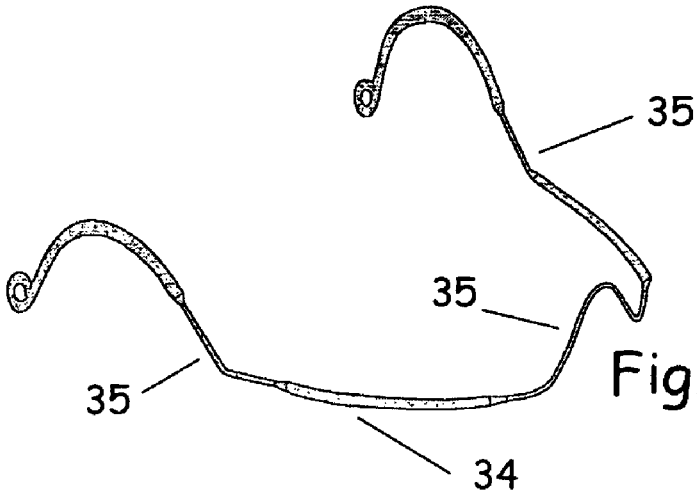
FIG. 5 is a view in perspective showing still another embodiment of the invention with a malleable wire frame having varying diameters for ease of bending purposes.

In FIG. 5, a wire frame 34 is made from a wire with varying diameters. As evident, portions 35 of the wire frame which are intended to be bent for facial conforming purposes are thinner in diameter to facilitate the bending.

It should be apparent my protective mask is very effective for filtering out unwanted airborne particles. Because of increased filtration area and fitting snugly to the perimeter of the face while not deforming the nose, it is worn without bother for extended periods thereby virtually eliminating unfiltered air. When not needed, it is comfortably at the ready, hanging around the neck.

Having described the invention in its preferred embodiment, it should be clear that modifications can be made without departing from the spirit of the invention. It is not intended that the words used to describe the invention nor the drawings illustrating the same be limiting on the invention. It is intended that the invention only be limited by the scope of the appended claims.

I claim:

1. A personalized protective mask conforming to an individual's face contour for either wearing over the face in an in-use mode for comfortably and effectively inhibiting the inhalation of airborne contaminates or wearing around the neck in a stand-by mode for quickly positioning over the face, said protective mask comprising:

(a) a continuous malleable wire frame having an inverted U-shaped nose section for sitting on the individual's nose bridge, a right cheek section and a left cheek section, each said cheek section extending substantially horizontally from the nose section, a right ear section extending from the right cheek section, and a left ear section extending from the left cheek section, each said ear section shaped for fitting over a top of one of the individual's ears, and wherein said nose section, right cheek section, left cheek section, right ear section and left ear section is each individually bendable;

(b) a filtration bag positioned on the malleable wire frame, said filtration bag sized to cover the individual's nose and mouth; and (c) a tether having a length to extend around the individual's head backside and having two terminuses with one terminus attached to one ear section and the other terminus attached to the other ear section for drawing the wire frame towards the individual's ears, whereby the individual personalizes the protective mask by manually bending the sections of the malleable frame to conform to the individual's nose bridge and cheek bones to closely follow the contour of the user's face and then tightening the tether for a substantially air-tight fit of the malleable frame and filtration bag over the individual's nose and mouth for preventing the inhalation of the airborne contaminates by the individual.

2. The personalized protective mask of claim 1 wherein each ear section has a loop at its terminus for holding an end of the tether.

3. The personalized protective mask of claim 1 wherein the tether further has a tightening means interposed thereon for loosening and tightening the tether.

4. The personalized protective mask of claim 3 wherein the tether is an elongated cord.

5. The personalized protective mask of claim 3 wherein the tightening means is a spring-loaded tensioner.

6. The personalized protective mask of claim 1 wherein the tether is an elastic band.

7. The personalized protective mask of claim 1 wherein the malleable wire frame has a constant diameter.

8. The personalized protective mask of claim 1 wherein the malleable wire frame has a plastic cladding on selected cheek sections and a plastic cladding on selected ear sections for rigidifying the cladded areas to serve as datum in conforming the wire frame to the individual's face.

9. The personalized protective mask of claim 1 wherein the wire frame member has varying diameters for directing bending forces to thinner diameter areas where bending adjustments are needed.

10. A personalized protective mask conforming to an individual's face contour for comfortably wearing over the face in an in-use mode and effectively inhibiting the inhalation of airborne contaminates or for wearing around the neck in a stand-by mode, said protective mask comprising:

(a) a continuous malleable wire frame, said wire frame including a left side and a right side joined together, each side when viewed in elevation having a generally flared U-shape with a cheek section extending substantially horizontally, a nose section extending upwardly and outwardly from one end of the cheek section, and an ear section extending upwardly and outwardly from another end of the cheek section for fitting over a top of the individual's ear and having an attachment means at its terminus, each said section individually bendable;

(b) a filtration bag positioned on the malleable wire frame, said filtration bag sized to cover the individual's nose, mouth, and chin; and (c) a tether having a length to extend around the individual's head backside and having two terminuses with one terminus attached to the attachment means of the left side ear section and the other terminus attached to the attachment means of the right side ear section for drawing the wire frame towards the individual's ears, whereby the individual personalizes the protective mask by bending the sections of the malleable frame as needed for causing the malleable frame to substantially continuously follow the individual's nose bridge and cheeks and extend over the ears and by tightening the tether for a substantially air-tight fit of the malleable frame and filtration bag fully over the individual's nose, nostrils, and mouth for preventing the inhalation of the airborne contaminates by the individual.

11. The personalized protective mask of claim 10 wherein the ear sections each further extend downwardly in a curved fashion with a terminal loop for holding one end of the tether.

12. The personalized protective mask of claim 11 wherein the tether is an elongated cord with a spring-loaded tensioner positioned thereon for adjusting the fit of the protective mask.

13. The personalized protective mask of claim 12 wherein the filtration bag is air permeable.

14. The personalized protective mask of claim 13 wherein the filtration bag has elastic edging for creating a snug fit to the individual when worn in an in-use mode.

15. A personalized protective mask conforming to an individual's face contour for wearing over the face in an in-use mode or for wearing around the neck in a stand-by mode, said protective mask comprising:

(a) a continuous malleable wire frame having a manually bendable inverted U-shaped nose section for sitting on the individual's nose bridge, a manually bendable first slightly curved cheek section extending substantially horizontally from the nose section, a manually bendable second slightly curved cheek section extending substantially horizontally from an opposed end of the nose section, a manually bendable first ear section extending from the first cheek section, and a manually bendable second ear section extending from the second cheek section, each said ear section having an arch-shape for fitting over a top of one of the individual's ears;

(b) a filtration bag positioned on the malleable wire frame, said filtration bag having an elastic edging for creating a snug fit to the individual when worn in the in-use mode and sized to cover the individual's nose, mouth, and chin; and (c) an elongated cord having a length to extend around the individual's head backside for use in either the in-use mode or in the stand-by mode, said elongated cord having two terminuses with one terminus attached to the first ear section and the other terminus attached to the second ear section for drawing the wire frame towards the individual's ears and further having a spring-loaded tensioner positioned thereon for adjusting the fit of the protective mask, whereby the individual personalizes the protective mask by first bending the nose, cheek and ear sections of the malleable frame to conform to the individual's nose bridge and cheeks and extend over the ears and then tightening the tether for a substantially air-tight fit of the malleable frame and filtration bag fully over the individual's nostrils and mouth for preventing the inhalation of the airborne contaminates by the individual.

16. The personalized protective mask of claim 15 wherein the nose section, cheek sections, and ear sections of the wire frame are contiguous.

17. The personalized protective mask of claim 16 wherein the filtration bag is air permeable.

* * * * *